United States Patent [19]

Pirooz et al.

[11] 3,949,153

[45] Apr. 6, 1976

[54] ELECTRIC POWER TRANSMISSION LINE

[75] Inventors: Perry P. Pirooz, Toledo, Ohio; Anthony P. Schmid, Riga, Mich.; Dennis T. Sturgill, Toledo, Ohio

[73] Assignee: Owens-Illinois, Inc., Toledo, Ohio

[22] Filed: Nov. 14, 1973

[21] Appl. No.: 415,919

[52] U.S. Cl. ..... 174/15 C; 174/68 C; 174/110 A

[51] Int. Cl.[2] ..... H01B 7/34; H01B 7/18

[58] Field of Search ..... 174/15 C, 24, 26 R, 26 G, 174/68 R, 68 A, 68 C, 27, 36, 110 A, 102 SC, 137 R, 137 A, 137 B, 138 C, 141 C, 140 C; 338/216, 306, 308, 334; 117/201, 211, 221, 229, 124 A, 124 B, 124 C, 124 T, 169 A; 106/39.8, 54, 53

[56] References Cited

UNITED STATES PATENTS

| | | | |
|---|---|---|---|
| 2,092,647 | 9/1937 | Hobart | 174/DIG. 7 |
| 2,273,135 | 2/1942 | Ohnesorge et al. | 174/37 X |
| 3,088,833 | 5/1963 | Pirooz | 106/54 X |
| 3,202,754 | 8/1965 | Ruch | 174/68 R;37 X |
| 3,329,764 | 7/1967 | Tanges, Jr. | 174/36 X |
| 3,387,994 | 6/1968 | Dunton et al. | 117/124 B |
| 3,429,979 | 2/1969 | Davey | 174/15 C |
| 3,594,492 | 7/1971 | Bahder | 174/36 |
| 3,614,290 | 10/1971 | Plate | 174/26 |
| 3,647,531 | 3/1972 | Matsushita | 117/229 X |
| 3,677,814 | 7/1972 | Gillery | 117/124 A |
| 3,729,575 | 4/1973 | Harding et al. | 174/140 C X |
| 3,770,568 | 11/1973 | Graff et al. | 117/124 A X |
| 3,776,764 | 12/1973 | Takagi et al. | 174/124 A |

FOREIGN PATENTS OR APPLICATIONS

| | | | |
|---|---|---|---|
| 560,209 | 3/1944 | United Kingdom | 174/15 C |

*Primary Examiner*—Arthur T. Grimley
*Attorney, Agent, or Firm*—Harold F. Mensing; E. J. Holler

[57] ABSTRACT

A high voltage electric power transmission line having an electrical power carrying capacity of 50 megawatts or more. An electrical power conductor is contained within a substantially rigid dielectric casing formed of a plurality of elongated tubular glass casing sections hermetically bonded together linearly end to end forming a continuous elongated casing around the conductor. The casing is loosely contained in an outer duct which permits lateral movement of the casing in the duct but places a maximum limit on such movement.

14 Claims, 10 Drawing Figures

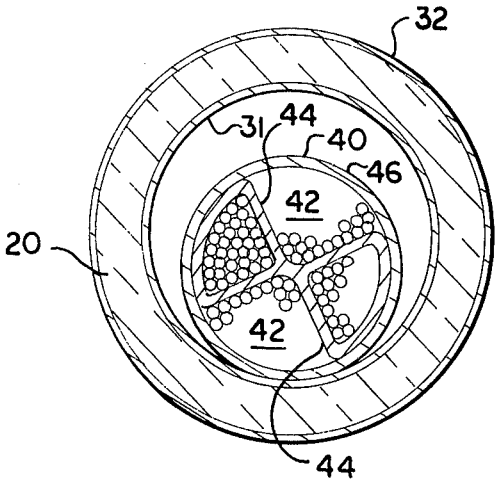
FIG. 1
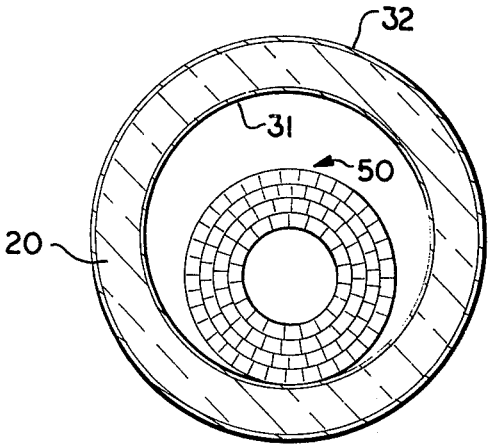
FIG. 2
FIG. 6
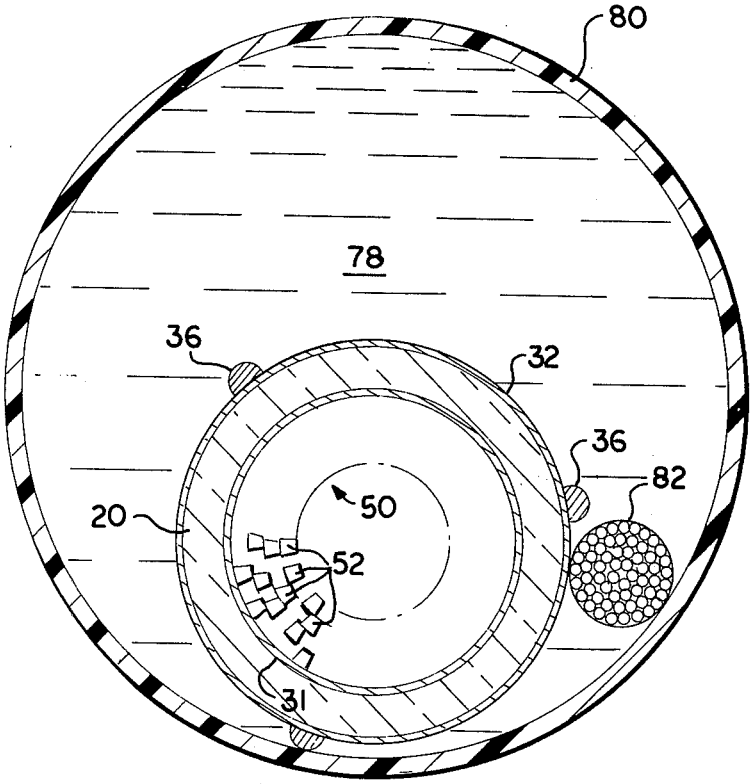

ELECTRIC POWER TRANSMISSION LINE

BACKGROUND OF THE INVENTION

In a majority of the prior art insulated electrical transmission lines, commonly referred to as transmission cables, the dielectric covering or primary electrical insulation consists wholly or partially of organic materials that are susceptible to breakdown when subjected to prolonged temperature incursions of over 100°C. For example, the widely accepted oil impregnated paper wrapped conductor cables are operated so that the temperature at the conductor-insulation interface does not intentionally exceed 85°C for any sustained period of time. This greatly restricts the power-handling capability of such cables. In spite of its limitations oil-paper cable dominates the transmission cable market. An example of a prior art transmission line having such a cable is found in U.S. Pat. No. 3,429,979 of E. L. Davey issued Feb. 25, 1969.

It is quite apparent to those skilled in the art that transmission cable technology would be advanced if a cable could be found which provided an improved outward transfer of heat away from the conductor. The advancement would be greater if at the same time the dielectric material surrounding the conductor could withstand prolonged temperature incursions of 200°C or more without catastrophic failure. Accordingly, the electric power industry has expended and is continuing to expend, at an increasing rate, large sums of money on research and development work in search of an improved transmission cable. Although workable cable systems have resulted from these efforts the new systems have not been able to gain dominance over oil-paper cable systems.

Glass materials in general have long been recognized for their dielectric properties and have been used widely for dielectric members in electrical equipment. It is also well known that most glass materials have relatively high coefficients of heat transfer and are not subject to chemical decomposition upon being heated. The softening point temperatures of most glass materials fall between the melting point temperatures of aluminum and copper, the commonly used conductor materials. Yet, in spite of all of these attributes, no one has disclosed, prior to the date of this invention, a high voltage electric power transmission cable which utilizes a glass casing as the primary electrical insulation and wherein the casing comprises a plurality of longitudinally seamless tube sections bonded together end to end.

Summary of the Invention

Generally speaking this invention relates to a high voltage electrical power transmission line utilizing a dielectric glass casing as the primary insulation for an electrical conductor. More specifically it relates to such a transmission line wherein the dielectric casing is formed of a plurality of hollow tubular casing sections hermetically bonded together end to end forming an integral casing having a length / O.D. (outside diameter) ratio of at least 200:1. Preferably the casing is formed by butt fusing the ends of adjoining casing sections together with or without the aid of a solder glass. Adjoining sections of the casing are aligned axially to avoid catastrophic stresses at the joints such as might be caused by subjecting excessively misaligned casing sections to axial loads encountered during installation of the casing or subsequently during operation of the line. Inner and outer surfaces of the casing have semi conductive layers or coatings which have a number of critical functions.

The electrical conductor may be a conventional type high voltage conductor made of copper strands grouped into segments with the segments being isolated from each other by electrical separators. Other metallic conductors, such as a sodium type conductor or a radially expandable stranded conductor, may be used.

The dielectric glass casing is loosely contained within an outer duct. Preferably the I.D. of the duct is chosen so as to limit the extent of maximum lateral movement of the glass casing in the duct and thus control the extent of gyration or buckling of the glass casing. The outer duct may be formed of a conductive material, such as steel, or a non-conductive material, such as plastic or a fiberglass-resin composite material. If a corrodible metal material is used, protective coatings for inhibiting corrosion or electrical erosion are applied to the inner and outer surfaces of the metal duct. In an embodiment where the basic duct material is non-conductive, a ground conductor is provided.

Fluids having good heat transfer characteristics are used to fill open areas between the conductor and the casing and between the casing and the outer duct.

Accordingly it is a general object of this invention to produce an improved high voltage transmission line of the insulated conductor type which has the capability of being operated at temperatures that exceed the maximum permissible operating temperature of prior art oil impregnated paper insulated cables. This object and other more specific objects and also various advantages will be apparent as the detailed description of preferred embodiments of this invention is read in view of the accompanying drawings.

BRIEF DESCRIPTION OF THE DRAWINGS

FIG. 1 is a lateral cross sectional view of an embodiment of the invention showing a segmented stranded conductor loosely contained in a dielectric glass casing.

FIG. 2 is a lateral cross sectional view of an embodiment similar to that of FIG. 1 but with a radially expandable stranded conductor shown with its strands in a compact mode.

FIG. 6 is a view similar to FIG. 5 but with a non-metallic outer duct and the radially expandable stranded conductor of FIG. 3 with its strands shown in a radially separated mode.

DETAILED DESCRIPTION OF THE INVENTION

Figure 10:
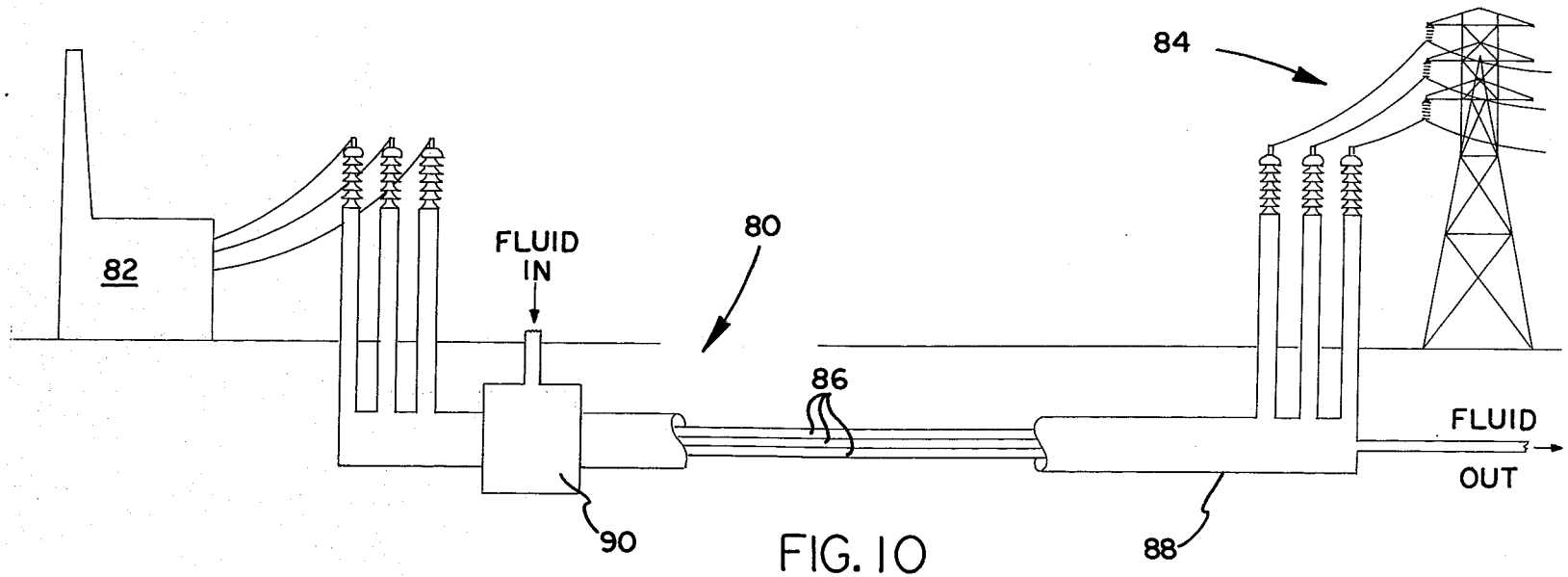
FIG. 10 is a generally schematic view of a three phase transmission system wherein three glass insulated conductors are loosely contained within a single outer duct.

Referring to the drawings there are shown several different embodiments of high voltage electric power transmission lines produced in accordance with the teachings of this invention. Each transmission line has a glass dielectric casing 20 which surrounds an electrical conductor. The dielectric casing 20 is basically the same in each of the several embodiments. Essentially it comprises a series of aligned tubular dielectric glass casing sections 22 hermetically bonded together end to end forming an elongated casing assembly having a length to outside width or diameter ratio greater than 200:1. The hollow casing 20 may be ovaler or polygonal in cross-section but those having circular cross-sections with concentric inner and outer circumferential surfaces are preferred.

The wall of the dielectric casing is monolithically formed of fused glass and is not to be confused with casings having walls basically formed of glass fibers or glass particles bonded into a mass by means other than thermal fusion. The composition of the glass is selected so that the electrical resistivity of the glass material is higher than $10^{15}$ ohm-cm at 20°C. Preferably the dielectric glass casing has a thermal expansion in the range of $3–7 \times 10^{-6}$ cm/cm°C in a temperature range of 0°–300°C. However, the lower limit may be reduced if suitable bonding techniques for lower expansion glasses can be developed. Essentially the glass has a dielectric strength greater than 300 volts per mil at 200°C for the wall thickness involved. The dielectric constant expressed as K must be less than 7 for a.c. (alternating current) applications and preferably less than 20 for d.c. (direct current) applications. The dissipation factor expressed in terms of tan $\delta$ is less than 0.003. The loss factor expressed in terms of the product of K tan $\delta$ is less than 0.02 except that in d.c. applications it can be higher if the contribution is due to an increase in the K value rather than the tan $\delta$ value. The dielectric glass composition is also chosen with the object of obtaining as high a thermal conductivity as is possible without unduly sacrificing electrical or physical properties of the glass. Preferably the thermal conductivity is greater than 0.002 calories per second through a surface area of glass equal to 1 $cm^2$ under a 1°C thermal gradient through a layer 1 cm thick.

The dielectric casing is made of a glass composition that is as free as is practically possible from alkali ions. A glass composed of 98% $SiO_2$ i.e. essentially fused silica, satisfies the aforementioned properties but due to inherent problems in forming and working it other vitreous glasses are preferred. For example an alkaline earth alumna borosilicate glass composition made in accordance with the disclosure contained in a commonly assigned copending patent application entitled "Glass Conduit For Electrical Conductors" filed Nov. 14, 1973, U.S. Ser. No. 415,739 by Perry P. Pirooz, the disclosure of which is hereby incorporated by reference, has all of the essential properties and can be formed into longitudinally seamless hollow tubing by the well known updraw tube forming process. A specific example of such a glass composition consists essentially of the following:

| Oxide | Weight % |
|---|---|
| $SiO_2$ | 46.2 |
| $B_2O_3$ | 14.0 |
| $Al_2O_3$ | 16.4 |
| CaO | 13.5 |
| MgO | 10.1 |

It is to be understood that variations of this composition and other compositions that have the specified essential properties may be used. Also the tubular casing sections may be formed by other than the updraw process. Casting processes including centrifugal casting may be used. The casing sections shown in the drawings are cylindrical in form. It is important that the concentricity of their inner and outer circumferential surfaces and the uniformity of their wall thickness be as near to perfection as is practically possible, particularly at the ends of the sections. Also care must be exercised in batching, melting, refining and forming the glass so that the resultant tube section is substantially vitreous, homogeneous and as free as is practically possible from seeds, bubbles, chords and the like imperfections.

Figure 4:
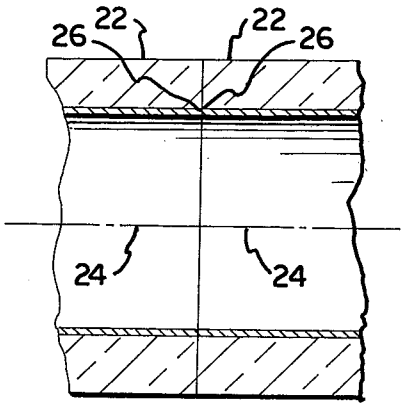
FIG. 4 is similar to FIG. 3 but is of a joint that is produced by directly fusing the bare ends of adjacent casing to each other without the aid of a solder glass.
Figure 3:
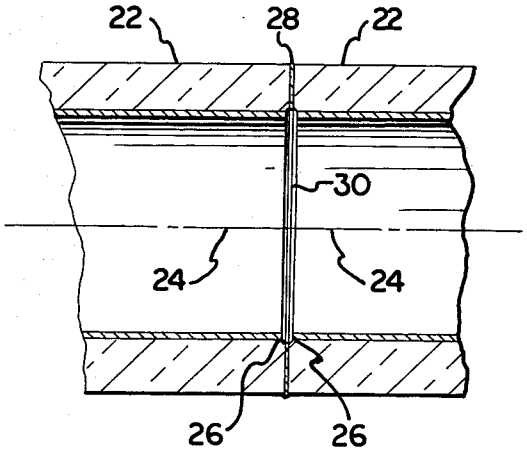
FIG. 3 is a longitudinal sectional view of a portion of the dielectric casing showing a solder glass type joint between adjacent casing sections.
Figure 5:
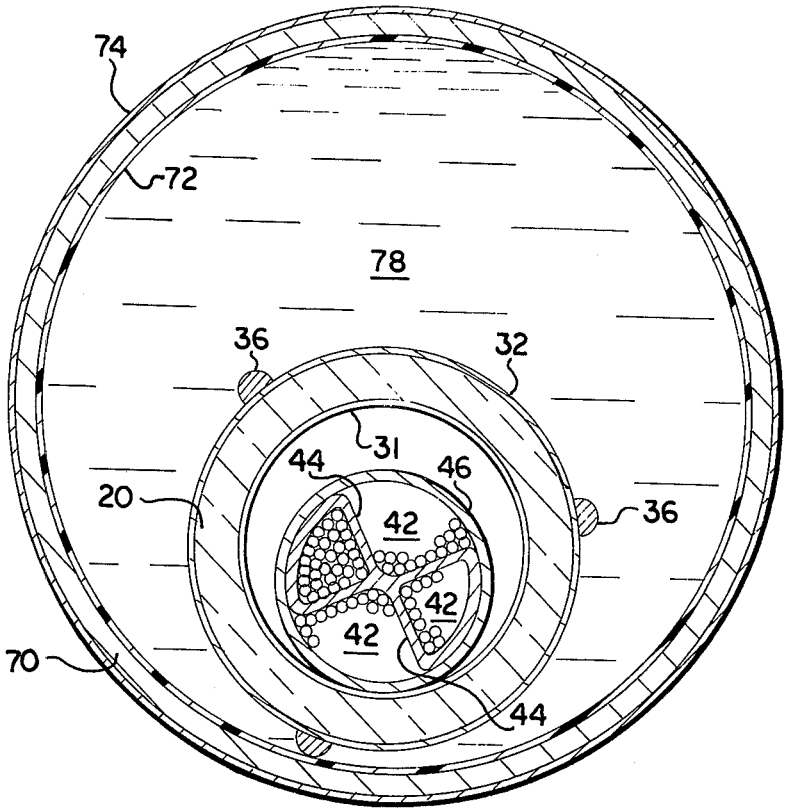
FIG. 5 is a lateral cross sectional view showing the dielectric casing and conductor assembly of FIG. 1 loosely contained within a metallic outer duct.

The ends of adjacent casing sections 22 may be bonded together by any means that produces a substantially stress free joint which will withstand the mechanical and electrical stresses encountered during installation and operation. Joints 28 produced by fusing together the ends of adjacent casing sections by means of a solder glass bonding agent 30 have proven to be satisfactory (see FIG. 3). Another method of producing a satisfactory joint is to fuse the bare ends of adjacent casing sections together such as by lampworking without the aid of a solder glass (see FIG. 4). This latter process usually requires subsequent thermal treatment for stress relief. Conceivably it is possible that bonding agents other than solder glass may be used. Such bonding agents may not even require heat. However, it is essential that the casing sections be bonded together and that the bonded joint be impervious to the flow of fluids and capable of withstanding the same electrical stresses applied to the casing. Preferably at least the joints that must be produced in the field are produced with the aid of a solder glass as a bonding agent.

Various solder glass compositions of different constituent ratios may be used. In essence, the solder glass must remain substantially homogeneous, vitreous, have a fusion temperature that is lower than the deformation temperature of the casing glass, a thermal expansion coefficient lower than that of the casing glass and an electrical resistivity of at least $10^{10}$ ohms per centimeter at 150°C. Preferably the fusion temperatures of the solder glass is lower than the stress relief temperature of the casing glass. An alkali-free, zinc-lead-borate solder glass prepared in accordance with the teachings disclosed in the copending commonly assigned patent application entitled "Vitreous Seals For Glass Electrical Conduits" U.S. Ser. No. 415,738, filed Nov. 14, 1973 by Perry P. Pirooz, inventor the disclosure of which is hereby incorporated by reference, was found to be suitable for bonding together the ends of casing sections made of aforementioned specific casing composition. A specific example of such a solder glass composition consists of the following constituents present in the indicated proportions.

| Oxide | Weight % |
|---|---|
| $SiO_2$ | 7.6 |
| $Al_2O_3$ | 3.9 |
| $B_2O_3$ | 25.0 |
| ZnO | 52.5 |
| PbO | 11.0 |

To produce a solder glass joint 28 between casing sections, preferably the end faces of the casing sections to be joined are coated with a thin layer of solder glass material such as by dipping the casing ends in a molten solder glass. Subsequently the coated ends of adjacent casing sections are aligned with each other, and heat fused together forming a hermetic joint seal. The heating time and temperature should be such that it does not cause deformation of the casing glass. A firing cycle on the order of 650°–800°C for 15–60 minutes is preferred. The thickness of the solder glass in the solder glass joint 28 is held to a minimum i.e. preferably between 0.5 and 3 mm measured in the direction of the casing axis.

The ability of the assembled glass casing to withstand axial loads is enhanced by precisely aligning the bore axes 24 of adjacent casing sections 22. The amount of tolerable angular misalignment is dependent in part upon the total length of the casing, its coefficient of thermal expansion and its outside diameter. For casings having a thermal expansion in the previously specified range, the angular axial misalignment at the joint is preferably not more than 1°.

It is also important that the circumferential edges 26 of the bores of adjacent sections 22 substantially coincide with each other when the casing sections are joined together. Offsets or steps from the bore surface end of one casing member to the bore surface end of the adjoining section would be vulnerable to mechanical shock and stress in instances where a prefabricated conductor is installed by pulling the conductor through the assembled casing. Such offsets would resist the movement of the conductor through the casing. During movement of the conductor, the offset portions of the casing would bear a disproportionately high amount of stress as compared with casing surfaces where there is smooth transition from one section to another. Preferably the offset or step at the joint caused by a lack of concentricity of a bore edge 26 or lateral misalignment of the bore axes 24 should be less than ½ mm.

The inner surface of the glass casing 20 is provided with a means 31 for bringing this surface to a potential substantially equalling that of the conductor. One method of providing such a means is to make a surface layer of the casing semi conductive. The term semi conductive in this instance is intended to mean having an electrical resistivity between 3 milliohms and $10^8$ ohms per square. A suitable conductive layer and a method of producing it is disclosed in a commonly assigned copending application entitled "Semi Conductive Coatings For Glass Conduits" U.S. Ser. No. 415,737, filed Nov. 14, 1973 in the name of Anthony P. Schmid, inventor. The disclosure in this application is hereby incorporated in the present invention by reference. Generally speaking, such a semi conductive layer is produced by introducing a gas saturated with a stannous compound to the glass surface to be treated while the glass surface is at a temperature sufficiently high to pyrolyze the compound so as to produce a tin oxide coating on the surface of the glass. Generally the pyrolysis temperature is between 300°C and 600°C. Although the term "tin oxide" is used to define the type of semi conductive material layer produced on the glass surface by this process, it is to be understood that the semi conductive layer is probably a complex mixture of oxides and silicates of various valance states. The resultant semi conductive tin oxide layer enhances the abrasion resistance of the glass surface, suppresses corona, inhibits the growth of metal dendrites in the glass dielectric and provides electrical shielding. Alternatively a layer of semi conductive glass material could be fused to the inner surface of the glass casing. Preferably the electrical resistance of the semi conductive layer or coating is between 200 and 1500 ohms per square. The semi conductive material may also be selected so that it provides a barrier to suppress the diffusion of metals of the conductor into the glass casing which might occur under the influence of the electric field present under operating conditions. This is of importance in the FIGS. 2 and 6–8 embodiments where the metal of the conductor is in direct contact with the semi conductive metal oxide surface layer.

A semi conductive layer 32, smilar to that described above but of higher conductivity, may be applied to the outer surface of the glass casing. A thin wrapping 34 of highly conductive material such as copper foil may be applied over the outer semi conductive layer 32.

At least an outer surface portion of the casing is self-compressioned by means of thermal treatment in accordance with well known processes for producing compressioned surface layers on glass by heat treatment. The compression measured at the surface is preferably above 10,000 psi. This enhances the casing's capability to withstand bending without breaking. The inner surface portion of the casing may be similarly self-compressioned to further enhance this capability.

Since scratches and abrasions on the surface of the glass casing provide sites for concentration of stress which may ultimately cause the glass to crack, protection from such damage is important. The aforementioned tin oxide layer offers some protection because of its hardness. Preferably the outer glass surface has additional protection in the form of one or more protective members 36 such as skid wires formed of a plastic material or a soft metal such as bronze. The protective members shown in the drawings have a D-shaped cross section and are helically wrapped around the casing with their flat sides towards the casing.

The dielectric glass casing 20 may be adapted for use with various types of conductors. In the FIG. 1 embodiment, the conductor 40 is a conventional stranded copper conductor of the segmented type wherein equal numbers of conductor strands are divided into quadrant shaped groups 42 by means of electrical separators 44. This segmented conductor has a thin external wrapping or covering 46. The conductor is loosely contained within the casing and is free to move both axially and laterally. The free area between the outside diameter of the segmented conductor and the inside diameter of the casing is between 30 and 85 percent of the cross sectional area encompassed by the glass casing. Advantageously this free space is filled with a fluid having good heat transfer characteristics. For example, a gas having a molecular weight in excess of 100, such as octafluorocyclobutance or sulfur hexafluoride.

The conductor 50 shown in FIGS. 2 and 6 is a stranded conductor which is free of external wrapping.

When the axial movement of this conductor in the casing is restrained and the conductor strands 52 become heated through normal operation of the transmission line, the conductor strands are free to move in a laterally outward direction until the outermost strands contact the inner surface of the casing. The direct contact of the conductor strands with the inner surface of the casing enhances heat transfer from the conductor to the casing.

Figure 7:
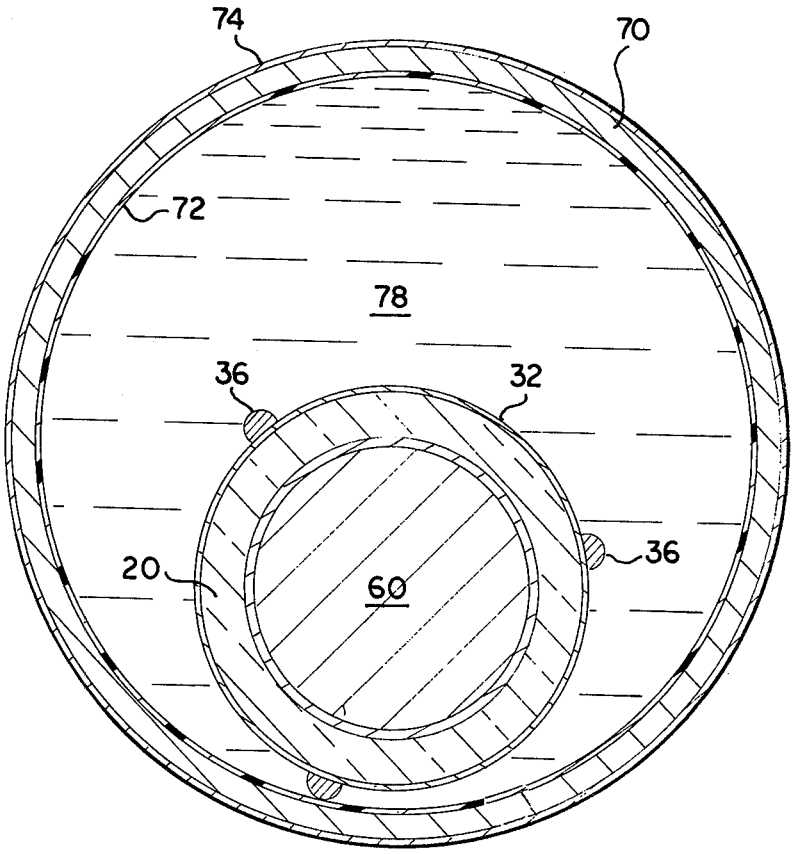
FIG. 7 is a view similar to FIG. 5 but with a sodium type conductor.
Figure 8:
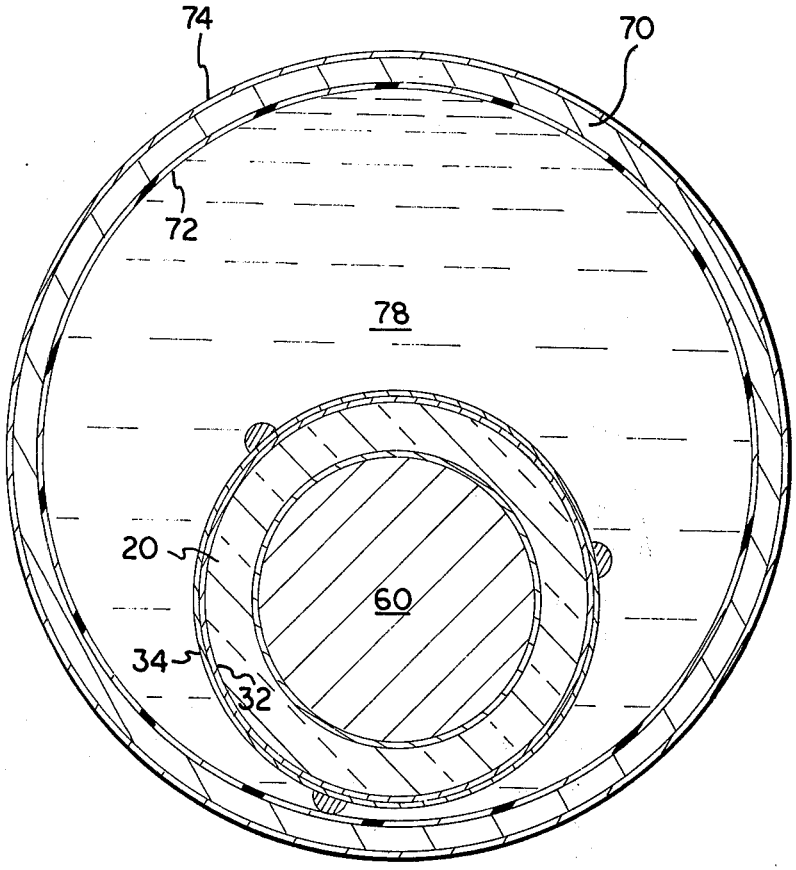
FIG. 8 is similar to FIG. 7 but with a metallic foil wrapped in intimate contact with the outer semi conductive surface layer of the dielectric casing.

The conductor 60 shown in FIGS. 7 and 8 is a sodium or sodium alloy which substantially fills the entire internal area of the casing 20. At normal operating temperature this sodium conductor is in a fluid state and thus free to move in axial directions within the casing.

Accordingly, the conductors in the various embodiments are free to move either laterally or axially within the casing as they become heated or cooled during operation. Since the conductors are not rigidly bound to the inner surface of the dielectric glass casing, axial stresses are not produced in the casing due to the higher coefficient of expansion of the conductor.

Figure 9:
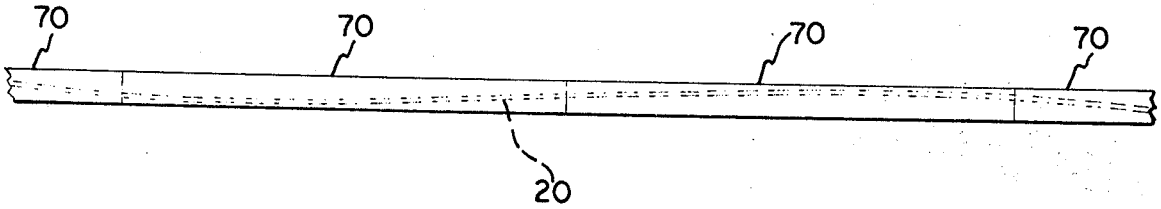
FIG. 9 is a longitudinal side view of reduced size of an isolated phase embodiment in which the dielectric casing, shown in dashed lines, is disposed in a wave pattern within the outer duct.

The functions of the outer duct are to protect the dielectric glass casing and contain the principal heat transfer fluid. Accordingly, the duct may be made of either electrically conductive material or non conductive material that is impervious to the flow of fluid and has sufficient strength to withstand the mechanical load to be encountered. In instances where long lengths of the glass casing are free to randomly move laterally in a gyratory or wave pattern such as is shown in FIG. 9, the inner diameter of the duct is selected with respect to the outer diameter of the casing so as to provide a constraint on the maximum distance that the casing is free to move laterally.

In the embodiments of FIGS. 5 and 7–9, the duct 70 may be made of metal, preferably a mild steel and is in the form of a pipe. The pipe sections are welded together to form an electrically continuous duct member that is substantially coextensive with the length of the casing. Protective coatings 72 and 74 of material such as asphalt are applied respectively to the inner and outer surfaces of the duct to inhibit corrosion or electrical erosion. A non conductive plastic such as PVC is used to form the duct 80 shown in FIG. 6. In this embodiment the fault current conductor is a stranded metallic conductor 82 located inside the duct. The fault current conductor could be in the form of a metallic sheet disposed around either the inner or outer surface of the duct. The essential feature is that a substantially continuous electrical path coextensive with the length of the casing be provided.

One of the primary advantages of using the above-described fluid impervious dielectric glass casing as the principal insulation for a high voltage conductor is the fact that glass has excellent heat transfer properties and these properties can be effectively utilized, particularly in instances where the outside of the casing is cooled by direct contact with a fluid coolant 78 preferably water. The heat transfer coefficient of solid glass is substantially higher than that of organic dielectric materials commonly used to insulate such conductors. A comparative thermal analysis will reveal the advantages of a glass encased fluid cooled transmission line. It is practical to operate such a line without providing a mass flow of coolant along the line but in most instances a dynamically cooled system is preferred.

There is shown in FIG. 10 a dynamically cooled three phase electrical transmission system 80 for transmitting large quantities of electrical power underground from a generating plant 82 at one end to a distribution center 84 at the other. Three separate dielectric casing-conductor assemblies 86 are contained within a single outer duct 88. A pump 90 causes coolant fluid to flow along the transmission line. Set forth below in chart form are exemplary data for three phase systems having specified phase to phase voltages. The data is based on a water cooled system wherein the coolant water flow rate is 300 or 500 gallons per minute over 1 mile runs.

| Voltage KV | Conductor Size MCM | Casing O.D. Inches | Casing Wall Thickness Inches | Duct I.D. Inches | Power Rating MVA | Flow Rate Gal./Min. |
|---|---|---|---|---|---|---|
| 138 | 2000 | 2.75 | 0.375 | 8. | 945 | 500 |
| 138 | 500 | 1.85 | 0.375 | 6. | 465 | 300 |
| 138 | 350 | 1.25 | 0.275 | 6. | 375 | 300 |
| 230 | 2000 | 3.16 | 0.58 | 10. | 1450 | 500 |
| 345 | 2000 | 3.60 | 0.83 | 10. | 2200 | 500 |
| 345 | 1500 | 3.41 | 0.83 | 10. | 1985 | 500 |
| 345 | 1000 | 3. | 0.8 | 10. | 1660 | 500 |
| 345 | 500 | 2.7 | 0.8 | 8. | 1140 | 500 |

Comparable dimensions may be used for isolated phase systems.

While the invention has been described by way of examples it is to be understood that the scope of the invention is not to be limited to only the specific examples described and shown but is to be primarily determined by the claims.

We claim:

1. A glass insulated electrical power transmission line comprising: a dielectric glass casing having inner and outer surfaces, said casing being made of a plurality of monolithic hollow cylindrical glass tube sections hermetically fused together seriately in an end to end relationship forming a casing capable of electrically insulating a conductor having a power carrying capacity of 50 megawatts, said casing having a length to outside diameter ratio in excess of 200:1, a conductor within said casing extending from one end of said casing to the other end thereof said conductor having a power carrying capacity of 50 megawatts and a semi-conductive material means on the inner surface of said casing for bringing said surface to an electrical potential substantially equal to that of said conductor.

2. A transmission line according to claim 1 wherein said glass tube sections are bonded together by means of a solder glass.

3. A transmission line according to claim 2 wherein the thickness of the solder glass between adjacent end sections is between 0.5 and 3 mm.

4. A glass insulated electrical power transmission line having a power carrying capacity in excess of 50 megawatts, said line comprising a dielectric glass casing having inner and outer surfaces, said dielectric glass having a dielectric strength greater than 300 volts per mil at 200°C for the wall thickness involved, said casing being made of a plurality of monolithic hollow cylindrical glass tube sections hermetically bonded together seriately an end to end relationship forming a casing having a length to outside diameter ratio in excess of 200:1, a conductor within said casing extending from one end of said casing to the other end thereof and a means on the inner surface of said casing for bringing said surface to an electrical potential substantially equal to that of said conductor.

5. A glass insulated electrical power transmission line having a power carrying capacity in excess of 50 megawatts, said line comprising a dielectric glass casing having inner and outer surfaces, said dielectric glass being essentially free of alkali metal ions, said casing being made of a plurality of monolithic hollow cylindrical glass tube sections hermetically bonded together seriately in an end to end relationship forming a casing having a length to outside diameter ratio in excess of 200:1, a conductor within said casing extending from one end of said casing to the other end thereof and a means on the inner surface of said casing for bringing said surface to an electrical potential substantially equal to that of said conductor.

6. A transmission line according to claim 5 wherein said dielectric glass has a resistivity higher than $10^{15}$ ohm-cm, a dielectric constant less than 20, a dissipation factor expressed in terms of tan $\delta$ less than 0.003 and a thermal conductivity greater than 0.002 calories per second through a surface area of glass equal to 1 square cm to 1°C thermal gradient through a layer 1 cm thick.

7. A glass insulated electrical power transmission line having a power carrying capacity in excess of 50 megawatts, said line comprising a dielectric glass casing having inner and outer surfaces, the dielectric glass of said casing having a coefficient of thermal expansion between $3 \times 10^{-6}$–$7 \times 10^{-6}$ per degrees C in a temperature range of 0°–300°C, said casing being made of a plurality of monolithic hollow cylindrical glass tube sections hermetically bonded together seriately in an end to end relationship forming a casing having a length to outside diameter ratio in excess of 200:1, a conductor within said casing extending from one end of said casing to the other end thereof and a means on the inner surface of said casing for bringing said surface to an electrical potential substantially equal to that of said conductor.

8. A glass insulated electrical power transmission line having a power carrying capacity in excess of 50 megawatts, said line comprising a dielectric glass casing having inner and outer surfaces, said glass casing having semi conductive layers on both inner and outer surfaces, said semi conductive layer on said inner surface having a resistivity of between 200 and 1,500 ohms per square and the semi conductive layer on said outer surface has a resistivity less than that of said semi conductive layer on said inner surface, said casing being made of a plurality of monolithic hollow cylindrical glass tube sections hermetically bonded together seriately in an end to end relationship foming a casing having a length to outside diameter ratio in excess of 200:1, a conductor within said casing extending from one end of said casing to the other end thereof and a means on the inner surface of said casing for bringing said surface to an electrical potential substantially equal to that of said conductor.

9. A glass insulated electrical power transmission line having a power carrying capacity in excess of 50 megawatts, said line comprising a dielectric glass casing having inner and outer surfaces, said casing having compressioned inner and outer surface layers each having a compression of 10,000 psi measured at the surface, said casing being made of a plurality of monolithic hollow cylindrical glass tube sections hermetically bonded together seriately in an end to end relationship forming a casing having a length to outside diameter ratio in excess of 200:1, a conductor within said casing extending from one end of said casing to the other end thereof and a means on the inner surface of said casing for bringing said surface to an electrical potential substantially equal to that of said conductor.

10. A glass insulated electrical power transmission line having a power carrying capacity in excess of 50 megawatts, said line comprising a dielectric glass casing having inner and outer surfaces, said casing being made of a plurality of monolithic hollow cylindrical glass tube sections hermetically bonded together seriately in an end to end relationship forming a casing having a length to outside diameter ratio in excess of 200:1, said casing being loosely contained within an outer duct, a conductor within said casing extending from one end of said casing to the other end thereof and a means on the inner surface of said casing for bringing said surface to an electrical potential substantially equal to that of said conductor.

11. A transmission line according to claim 10 wherein said conductor is free to move longitudinally with respect to said casing.

12. A transmission line according to claim 11 wherein said conductor is loosely contained within said casing so that there is a free space between said conductor and the inside of said casing, said free space being between 30 and 85 percent of the hollow area of said casing.

13. A glass insulated electrical power transmission line having a power carrying capacity in excess of 50 megawatts, said line comprising a dielectric glass casing having inner and outer surfaces, said casing being made of a plurality of monolithic hollow cylindrical glass tube sections hermetically bonded together seriately in an end to end relationship forming a casing having a length to outside diameter ratio in excess of 200:1, said casing sections being aligned with each other so that the angular misalignment between the bore axes of the adjacent casing sections is less than 1°, a conductor within said casing extending from one end of said casing to the other end thereof and a means on the inner surface of said casing for bringing said surface to an electrical potential substantially equal to that of said conductor.

14. A glass insulated electrical power transmission line having a power carrying capacity in excess of 50 megawatts, said line comprising a dielectric glass casing having inner and outer surfaces, said casing being made of a plurality of monolithic hollow cylindrical glass tube sections hermetically bonded together seriately in an end to end relationship forming a casing having a length to outside diameter ratio in excess of 200:1, the circumferential edges of the bores of adjacent casing sections coincide with each other within a tolerance of ½ mm, a conductor within said casing extending from one end of said casing to the other end thereof and a means on the inner surface of said casing for bringing said surface to an electrical potential substantially equal to that of said conductor.

* * * * *